US005694759A

United States Patent [19]

Caviness

[11] Patent Number: 5,694,759

[45] Date of Patent: Dec. 9, 1997

[54] PROCESS FOR PRODUCING POLYESTER YARNS ON AN OPEN END SPINNING MACHINE AND YARNS THUS PRODUCED

[75] Inventor: Tony F. Caviness, Laurinburg, N.C.

[73] Assignee: Waverly Mills, Inc., Laurinburg, N.C.

[21] Appl. No.: 760,784

[22] Filed: Dec. 5, 1996

Related U.S. Application Data

[62] Division of Ser. No. 614,780, Mar. 8, 1996.

[51] Int. Cl.[6] ..... D02G 3/02

[52] U.S. Cl. ..... 57/408; 57/245; 57/252; 57/400; 57/404

[58] Field of Search ..... 57/245, 243, 252, 57/255, 208, 400, 408, 404; 19/114

[56] References Cited

U.S. PATENT DOCUMENTS

| | | | |
|---|---|---|---|
| 2,937,413 | 5/1960 | Hollingsworth | 19/114 |
| 3,339,359 | 9/1967 | Ripka et al. | 57/58.89 |
| 3,584,451 | 6/1971 | Chrtek | 57/58.95 |
| 3,604,194 | 9/1971 | Edagawa et al. | 57/58.89 |
| 3,605,196 | 9/1971 | Wise et al. | 19/83 |
| 3,768,246 | 10/1973 | Tabata et al. | 57/156 |
| 3,831,369 | 8/1974 | Northrup et al. | 57/144 |
| 3,924,396 | 12/1975 | Bobkowicz et al. | 57/400 |
| 4,168,601 | 9/1979 | Didek et al. | 57/58.95 |
| 4,251,984 | 2/1981 | Ripka et al. | 57/58.91 |
| 4,347,647 | 9/1982 | Brown et al. | 19/128 |
| 4,392,276 | 7/1983 | Gauvain et al. | 19/97 |
| 4,646,389 | 3/1987 | Stahlecker et al. | 19/97 |
| 4,698,956 | 10/1987 | Clarke et al. | 57/2 |
| 4,729,214 | 3/1988 | Yngve et al. | 57/6 |
| 4,802,330 | 2/1989 | Yngve et al. | 57/238 |
| 5,361,574 | 11/1994 | Gebhardt | 57/408 |
| 5,396,688 | 3/1995 | Brown et al. | 57/404 |
| 5,419,952 | 5/1995 | Brown et al. | 57/413 |

FOREIGN PATENT DOCUMENTS

| | | | |
|---|---|---|---|
| 0 446 883 | 3/1991 | European Pat. Off. . | |
| 23 35 057 | 1/1975 | Germany . | |
| 2162039 | 7/1987 | Japan | 57/252 |

OTHER PUBLICATIONS

*Textile Industries, "Possibilities of polyester in open end spinning"*, vol. 143, No. 2, pp. 50–53, (1979).

*Polyester: Tomorrow's Ideas & Profits, "Short Staple Spinning"*, Derichs, Josef, et al, Brunnschweiler, Ed. (1993), 6 pages.

*Primary Examiner*—William Stryjewski

*Attorney, Agent, or Firm*—The Bell Seltzer Intellectual Property Group of Alston & Bird, LLP

[57] ABSTRACT

A method for producing substantially 100% polyester yarns on an open end spinning machine is described. The process involves acting on substantially 100% polyester sliver made of high tenacity, fine denier fibers with a negative tooth combing roll to individualize the fibers and feed them to the rotor of an open end spinning machine. Superior quality industrial gauge yarns can be produced from fine denier, high tenacity polyester fibers according to this method at a high rate of throughput and with few ends down.

22 Claims, 2 Drawing Sheets

PROCESS FOR PRODUCING POLYESTER YARNS ON AN OPEN END SPINNING MACHINE AND YARNS THUS PRODUCED

RELATED APPLICATIONS

This application is a divisional of application Ser. No. 08/614,780 filed Mar. 8, 1996.

BACKGROUND OF THE INVENTION

1. Field of the Invention

The invention generally relates to a method of producing polyester yarns on an open end spinning machine, and the yarns thus produced. More specifically, the invention relates to a method of making substantially 100% polyester yarns by using a negative tooth combing roll to pluck fibers from polyester sliver made from high tenacity, fine denier fibers and feed them to the spinning rotor of an open end spinning machine for spinning into a yarn, and the yarns thus produced.

2. Description of the Prior Art

Spun yarns, i.e., those made from staple fibers, are typically produced from one of two systems: ring spinning or open end spinning. Ring spinning of yarns is a multi-stage process, which requires use of a number of processing machines or stations. In a typical ring spinning process, the staple fibers are provided in mass form. These fibers are fed to a fiber opener, which separates the fiber mass into smaller tufts and removes waste materials. The opened fibers, which are randomly oriented, are fed to a card, where they are partially aligned relative to each other along their longitudinal axes. The fibers exit the card in the form of a web, which is then pulled through a condenser to produce an untwisted loosely combined fiber strand which is commonly called sliver.

The sliver is fed to a drawing frame, where the sliver is pulled through a series of roller pairs operating at different speeds to draft the sliver. The drawn sliver is then transported to a roving frame where it is drafted to a fraction of its sliver diameter to form a smaller strand known as roving. In addition to reducing the strand diameter, the drawing and roving processes further align the fibers contained in the strand structures. The roving is then wound onto a bobbin in order to impart a small amount of twist to the roving and to provide the roving in a form which is easily transportable to the spinning frame.

Upon transport to the spinning frame, the roving is again drafted by being fed through a series of roller pairs rotating at different speeds, and is then wound onto a bobbin-holding rotating spindle by way of a traveler, which moves around the rotating spindle. As the traveler moves the fiber strand around the rotating spindle, twist is inserted, to thereby form the drafted roving into a yarn. Because the bobbins on the spinning frame must be rotated on the spindles during yarn production, their size is limited. Thus, the packages must be doffed and replaced frequently, a process which obviously reduces spinning efficiency. In addition, the bobbins are usually too small for practical employment in many end uses, and thus the yarns from several bobbins are typically combined after spinning to form more usefully sized packages.

Open end spinning, in contrast, involves less manufacturing steps and therefore is generally considered to be a less expensive yarn production method. In particular, open end spinning eliminates the need for the roving stage common in ring spinning as well as a later winding process. A common open end spinning process is rotor spinning. The production of yarns by the rotor spinning method is typically performed as follows: sliver is produced in essentially the same manner as discussed above with respect to ring spinning. For example, the staple fibers are provided in, mass form. The fibers are fed to a fiber opener, which separates the fiber mass into smaller tufts and removes waste materials. The opened fibers, which are randomly oriented, are fed to a card, where they are partially aligned relative to each other along their longitudinal axes. The fibers exit the card in the form of a web, which is then pulled through a condenser to produce sliver. This card sliver can go directly to the open end machine or can be processed through drawing to further align the fibers before going to the open end spinning machine.

Sliver is then fed to a rotating wire or pin covered combing roll which plucks individual fibers from the sliver strand and partially aligns them. An air stream carries the individualized fibers in the form of a fiber stream from the combing roll to a rotating rotor. The rotor generally includes a groove-like collecting surface along its inner surface. Centrifugal forces resulting from the rotation of the rotor cause the fibers to be collected along this collecting surface inside the rotor. As the rotor continues its rotation, twist is added to the collected fibers, thereby forming a yarn structure.

Draw off rollers continuously withdraw the yarn through a separator, which assists in the insertion of twist in the yarn. The separator includes a specially configured opening known as a navel, the construction of which affects the yarn's structural appearance. As yarn is drawn out of the separator, fiber continues to be collected and twisted at the opposite yarn end within the rotor (hence the name "open end": yarn continues to be formed at the open end of the preceding section as fiber continues to be added and twist continues to be imparted.) The thus-produced yarn can therefore be continually wound onto packages.

Because the package forming itself does not form a part of the yarn spinning process like in the case of ring spinning, the package size is not limited in the open end spinning process like in the ring spinning processes. As a result, the frequent bobbin doffing and replacement that forms a part of the ring spinning process and the later winding process is avoided. Thus, the production of yarns by way of open end spinning processes is generally considered to be a more efficient process. In addition, because open end spinning requires fewer production steps, it has historically been viewed as a less expensive yarn production process than ring spinning. Open end spinning produces yarns which are typically somewhat weaker than their ring spun counterparts. As a result, the strength of the overall open end spun yarn has a greater dependency on the strength of the fibers themselves than does ring spinning.

Open end spinning can be used for the production of effect yarns as well as straight (i.e. substantially uniform) yarns. In producing effect yarns, the effects can be randomly or regularly produced by choice, such as by controlling the combing conditions to provide irregularly combed fibers and/or intermittently changing the processing rates (e.g. the rate of yarn fed to the combing roll) to thereby provide clumps of fibers which form slubs in the spun yarn.

While open end spinning has been found to be an efficient and effective method of producing many yarns, particularly effect yarns and cotton or blend yarns, difficulties have been encountered during attempts to open end spin yarns from synthetic fibers such as polyester. As discussed, e.g. in the article "Possibilities of Polyester in Open End Spinning" (R. L. Coble et al., *Textile Industries,* Vol. 143, no. 2, pp. 50–53 (1979)), polyester tends to leave a high degree of fiber and finish deposit build up on open end spinning machine parts due to its thermoplastic nature. The finishes common to polyester fibers tend to come off of the fiber and form a powdery residue, which leads to fiber breakage, gumming of machine parts, and the build up of static charges, among other things. This deposit build up represents a significant problem in efforts to open end spin polyester fibers. As a result of such fiber and finish deposit build up, attempts to open end spin unblended polyester fibers have typically produced poor quality yarns at unacceptably low levels of productivity.

In the above-referenced article to Coble et al., the authors concluded that the number of ends down, the amount of fiber deposit on the combing roll, and the number of defects tended to increase with an increase in yarn size. In other words, the authors had greater success spinning finer yarns than coarse ones. In addition, those authors concluded that although finer sized fibers could improve yarn strength, they tend to leave more deposits on the spinning machine, and that deposit formation is a major concern when processing polyester fibers through open end spinning. Further, the authors concluded that reductions in staple length reduced deposit levels and fiber damage. In sum, the authors concluded that to obtain the best results when open end spinning polyester fibers, one should use shorter staple lengths and higher denier fibers to produce finer count yarns. The authors of that article also proposed the use of combing rollers having a large negative tooth angle, noting that as the negative tooth angle moved from a large negative toward zero, the amount of combing roll deposits significantly increased.

Around the mid 1980's, approximately several years after the publication of the article of Coble et al., polyester manufacturers developed finer denier, high tenacity polyester staple fibers. As the Coble et al. article suggests would be the case, the finer denier polyester fibers since developed have been found to be even more difficult to spin on an open end spinning machine than previous fibers. Because many more of these finer denier fibers are required to produce a given yarn size, more fibers must be fed in at a much faster rate; therefore spinning of such 100% polyester fibers on open end spinning machines has represented a unique problem for textile manufacturers. Further, because of the high tenacities of these fibers, they would have a tendency to wear the parts of the open end spinning machines more quickly than weaker fibers.

Open end spinning of polyester yarns including blends with natural and man-made fibers and non-blended polyester is also discussed in the article "Short Staple Spinning" (Derichs, Josef, et al., *Polyester: Tomorrow's Ideas & Profits,* Brunnschweiler, Ed. (1993)). In that article, the authors recommend that to prevent thermal fiber damage of polyester fibers due to frictional stress occurring at the navel, fiber finishes and crimp should be optimized. In addition, the authors recommend that frictional stress at the combing roll should be kept from promoting polymer abrasion through the use of specially adapted combing roll coatings. They note, however, that the hard wear-resistant coatings tend to be very abrasive, and thus a combination of wear-resistant and non-abrasive coatings is desired. Further, the authors describe that favorable processing behavior could be accomplished with fibers which are insensitive to mechanical friction.

As discussed above, however, most commercial polyester fibers are sensitive to mechanical friction because of their thermoplastic nature and finishes. Accordingly, high strength open end spun 100% polyester yarns are generally not commercially available at the present. Thus, at least until seemingly perfect polyester fibers are developed (i.e. those which are strong, of fine denier, and which do not tend to build up on the open end spinning machine parts), it would be desirable to have a method for producing yarns made substantially entirely from commercially available polyester fibers at high levels of productivity with few defects.

SUMMARY OF THE INVENTION

Although attempts were made in accordance with the latest fiber and spinning roll technology to open end spin fine denier, high tenacity fibers with combing rolls traditionally used to spin polyester (i.e. those having a small positive tooth angle), the inventor has surprisingly discovered that by employing a negative tooth roll, superior coarse count yarns can be reliably produced from these fibers at high rates of production.

Attempts to open end spin straight yarns from fine denier, high tenacity polyester fibers using positive angle rolls conventionally used with polyester produced yarns having many defects. The presence of slubs in the thus-produced yarns suggested that the attack angle of the combing roll was insufficiently positive, since the presence of slubs is commonly associated with insufficient combing action by the combing roll. Thus one would expect that an increase in the combing roll angle to a greater positive angle and/or higher combing roll speeds would provide a greater amount of combing action and a reduction in slubs. Surprisingly, however, the inventor has discovered that by using a negative angle tooth rather than a larger positive angle tooth, superior coarse count open end spun yarns can be produced from fine denier, high tenacity fibers. In a preferred embodiment of the invention, the use of a combing roll having a small negative tooth angle is accompanied by an increased vacuum pressure in the spinning system and a relatively slow combing roll speed, to thereby provide superior quality yarns at high rates of productivity.

The present process utilizes a combing roll having negative teeth thereon (i.e. a negative tooth roll) to individualize the fibers from the feed staple and feed them to the rotor of an open end spinning machine. (As used herein, the terms "negative teeth" and "negative angle tooth" are used to describe teeth or pins of a combing roll which have a leading edge which is angled away from the direction of roll rotation.) In addition, though referred to generically as "teeth", it is noted that the term is meant to encompass conventional types of combing roll clothing such as wire pins or the like.

The staple which is fed to the combing roll is desirably formed substantially entirely from fine denier, high tenacity polyester fibers. Particularly preferred are fibers about 1.3 denier per filament (dpf) or less in size, and which have a single fiber tenacity (hereinafter "tenacity") of about 5 grams per denier (gpd) or greater and a staple length of about 1¼ to 2 inches. Each of the teeth of the negative tooth combing roll utilized is desirably angled away from the direction of rotation at a negative angle of about 0° to −10°, and preferably about −5°, from a radial line. Such negative tooth rolls have been employed for the production of effect yarns (e.g. slub yarns) and for fiber blends, but heretofore to the inventor's knowledge the negative tooth rolls have not been used to produce substantially 100% polyester yarns from fine denier, high tenacity fibers.

The combing roll acts on the sliver to pluck individualized (i.e. a single or small number of) fibers from the sliver and partially align them with respect to each other. An air flow cooperates with the combing roll rotation to effect removal of the individualized fibers from the roll proximate the spinning rotor.

The spinning rotor, which has a groove located along its inner circumference, is caused to rotate about its center axis. As the rotor rotates, the individualized fibers fed by the negative tooth combing roller are caused by the centrifugal forces to collect along the groove, where twist is inserted. In addition, a vacuum can be provided in a conventional manner to assist in the transport of the fibers from the combing roll to the rotor groove. In a preferred form of the invention, the rotor rotates at up to 90,000 rpm while vacuum pressure approaches about 85–90 millibars. The rotor is desirably boron-coated in order to enhance its durability, while the combing roll is diamond coated.

The twisted strand is withdrawn under tension through the navel of a separator by draw off rolls, where it emerges as yarn. Although it is noted that ceramic navels are generally more durable than those made from chrome, the inventor has found that the ceramic navels tend to wear the finish off of the polyester fibers more readily than chrome. Therefore, the inventor has determined that the benefit of reduced fiber damage achieved through use of a smooth chrome navel tends to outweigh the expense associated with the relatively shorter lifespan of the navel when spinning fine denier, high tenacity fibers.

The yarn is wound onto packages for transfer to further processing locations or to its end use location. The spun yarns are desirably sized for industrial-type end uses such as in the formation of belts, hoses and carpet backing. In a preferred form of the invention, the yarns are about 12 Ne (hanks per pound) or larger, preferably between about 10 and 4 Ne. Because they are measured on the indirect cotton system, the larger yarns thus have a lower value of Ne, as is known to those of ordinary skill in the art. In a particularly preferred embodiment of the invention, the yarns are about 4.5 to 4 Ne in size. The yarns thus produced are straight (i.e. non-effect yarns) and have few slubs or defects. In addition, the yarns can be produced at high rates of throughput with few ends down.

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like numbers refer to like elements throughout.

Figure 1:
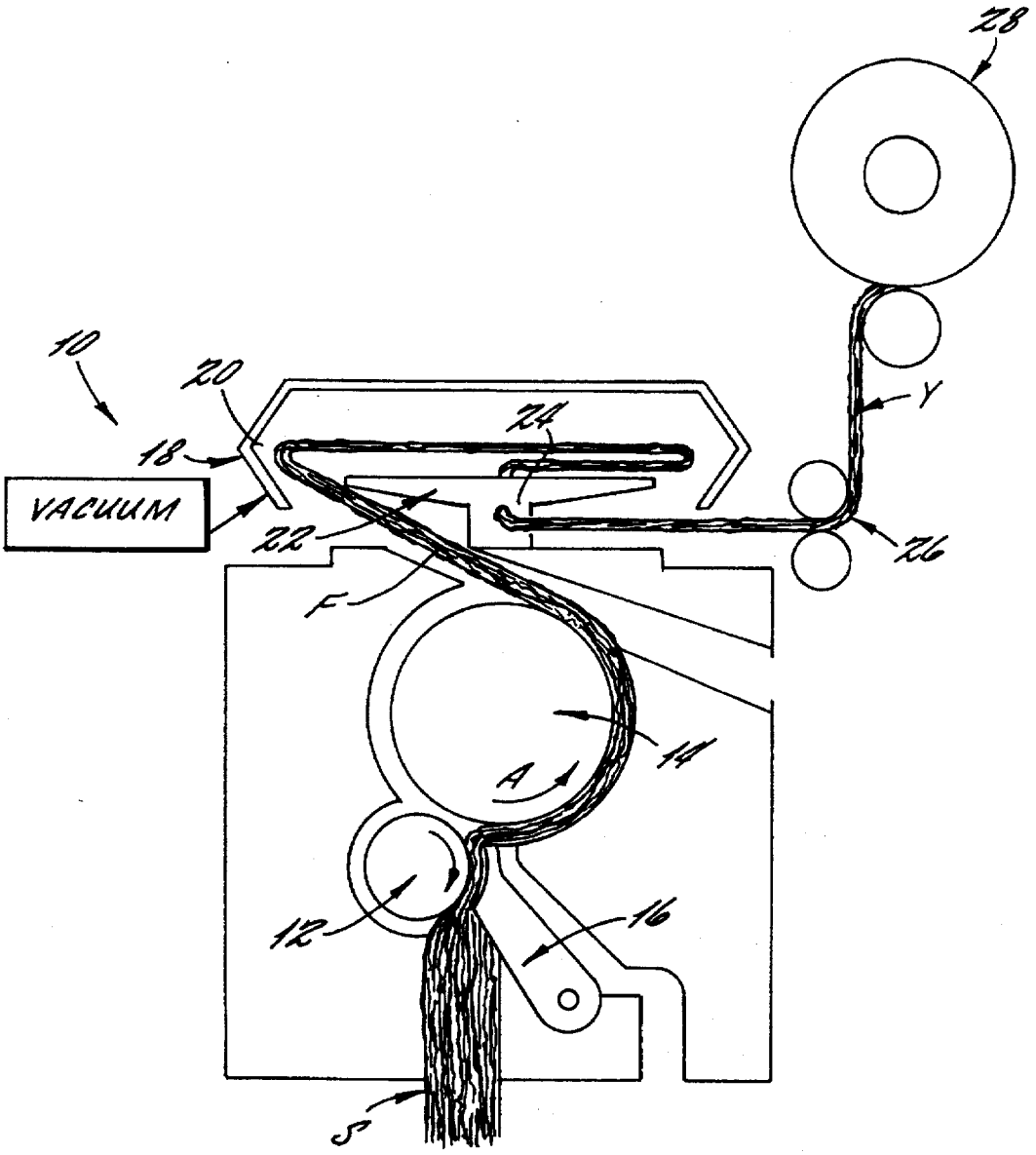
FIG. 1 is an axial section of an open end spinning machine arrangement which can be used to perform the method of the present invention.

FIG. 1 illustrates an example of an open end spinning machine 10 which can be used to perform the instant invention. The open end spinning machine 10 can be any of the conventional commercially available rotor spinning varieties, such as the AUTOCORO® manufactured by W. Schlafhorst AG and Co. or the like. The spinning machine 10 desirably includes a feed roll 12 for continuously feeding sliver S to the combing roll 14. As illustrated, a presser nose 16 desirably presses the sliver strand S against the feed roll 12, to ensure that the feed roll continually effects the sliver movement. In a preferred form of the invention, the feed roll rotates at a rate of about 4.73 yards per minute (ypm) to feed the sliver S to the combing roll 14. However, the feed roll rate and size of sliver can be varied.

The sliver S is desirably formed from substantially 100% polyester fibers, which are preferably of the fine denier, high tenacity variety. Particularly preferred are fibers which are about 1.3 denier per filament or less in size, and which have a tenacity of about 5 grams per denier or greater. Particularly preferred are fibers having a denier of about 1.2 or less, and a tenacity of at least about 6. The staple fibers desirably have a length of between about 1 and ¼ to 2 inches, and preferably about 1 and ½ inches. In addition, the level of fiber finish and crimp can also be selected according to the requirements of the spun yarn. The rate of sliver feed can be adjusted according to the method to affect the size of the spun yarn thus produced.

Figure 2:
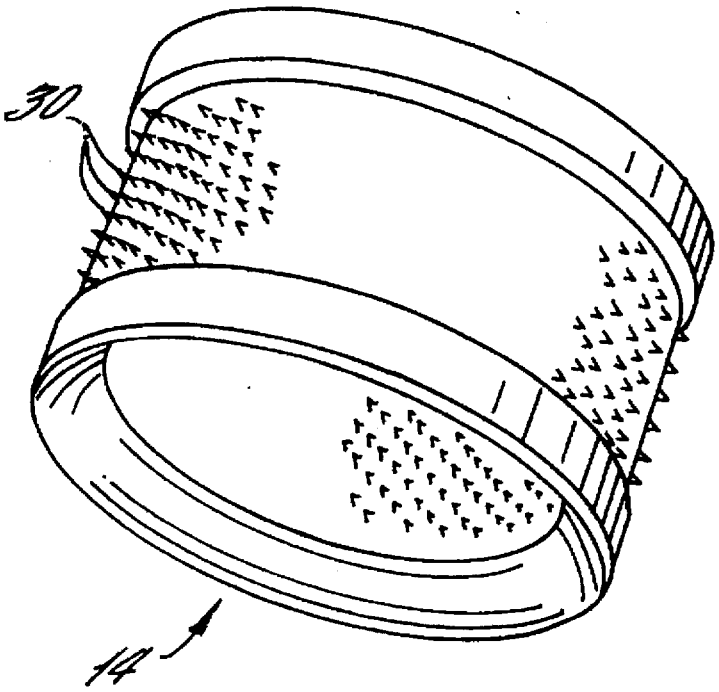
FIG. 2 is a perspective view of a negative tooth combing roll which can be used in the method of the present invention.
Figure 3:
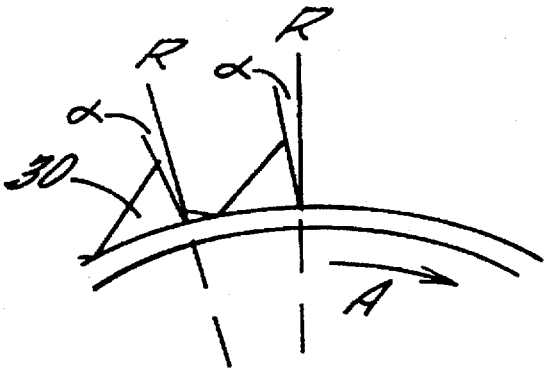
FIG. 3 is a side elevational view of a small section of the negative tooth combing roll illustrated in FIG. 2.

The combing roll 14, which has a series of teeth or pins 30 on its outer surface, rotates in the direction of fiber transport, and plucks fibers F from the sliver stream 8. The action of the combing roll 14 on the sliver strand S serves to individualize the fibers F, align them axially relative to each other to some degree, and to feed them to the rotor 18. As illustrated in FIGS. 2 and 3, the teeth 30 on the combing roll 14 are angled away from the direction of combing roll rotation (indicated by arrow A), in order to form a negative angle $\propto$ with respect to a radius R of the roll. In a preferred form of the invention, the combing roll 14 has a circumference of about 6¾ inches, and approximately 429 teeth (11 rows at 39 teeth per row), to provide approximately 63 to 64 teeth per inch. The teeth have a negative tooth angle $\propto$ with respect to the roll radius R and the direction of roll rotation. The leading edges of the teeth are preferably straight rather than compound or curved. Where the overall combing effect is substantially the same as with a non-curved or non-compound edge, a curved or compound edge including partial minor positive angled portions, but having an overall negative angle, can be employed. In a particularly preferred form of the invention, the teeth 30 are laser cut from a single piece of metal, and the teeth are provided with a diamond coated, durable matte finish. In this way, it has been found that effective individualizing and transport of the fibers F takes place, while fiber damage is minimized.

The individualized fibers F are transported by the combing roll 14 to a rotating rotor 18. the combing roll 14 is desirably operated at a speed of 7600 revolutions per minute (rpm), as will be discussed further herein. The rotor, which includes a circumferential groove 20 along its inner surface, is caused to spin rapidly about its axis. A vacuum source (not shown) is also provided in a conventional manner, to create an air flow for assisting in the transport of the fibers F from the combing roll 14 to the rotor 18 and channeling debris and small fibers to waste. In a preferred form of the invention, the vacuum is operated at a pressure of about 85–90 millibars in the rotor area. This pressure is substantially higher than that customarily recommended by open end spinning equipment designers. Vacuum pressures are typically maintained below the above-referenced pressures because a high vacuum tends to rob fibers from the rotor and channel them to waste. Obviously, however, the amount of vacuum pressure will vary depending on the length of the machine, since pressure is lost along the machine length. The inventor has discovered, surprisingly, that by running the vacuum at higher than recommended pressures and driving the combing roll 14 at the relatively slow rate of 7600 rpm, a desirable coarse count yarn is formed from high tenacity, fine denier fibers while fiber waste is minimized. Because the combing roll 14 can be run at relatively slow speeds in the method, fiber damage is reduced and the combing roll lifespan is increased. The rates of feed roll speed, combing roll speed, and rotor speed can be selected to achieve optimal results depending on the crimp and finish on the fibers being spun.

As the rotor 18 spins, the centrifugal forces resulting from the rotor motion cause the fibers to gather in the groove 20 of the rotor. The rotor groove 20 can be variously shaped, but in a preferred form of the invention is substantially T-shaped to provide coarse count yarns. Also in a preferred form of the invention, the rotor 18 is boron-coated in order to enhance its durability.

As the rotor 18 rotates, twist is inserted into the fibers F in the groove 20, thereby forming a yarn strand. The twisted strand is withdrawn through the navel 24 of a separator 22 by draw off rolls 26, where it emerges as yarn Y. Although it is noted that ceramic navels are generally more durable than those made from chrome, the inventor has found that the ceramic navels tend to wear the finish off of the polyester fibers more readily than smooth chrome. Therefore, the inventor has concluded that the benefit of reduced fiber damage achieved through use of a smooth chrome navel may tend to outweigh the expense associated with the relatively shorter lifespan of the navel when spinning fine denier, high tenacity fibers.

The yarn Y is wound onto packages 28 for transfer to further processing locations or to its end use location. Desirably, the spun yarns are sized for industrial-type end uses such as in the formation of belts, hoses and carpet backing. In a preferred form of the invention, the yarns are about 12 Ne (hanks per pound) or larger, and preferably between about 10 and 4 Ne. Particularly preferred are yarns in the 4.5 to 4 Ne size range. The method gives good throughput with few defects and ends down.

A comparative study of open end spun 100% polyester yarns made from 1.2 denier per filament, 1½ inch staple length, 6.6 grams per denier fiber tenacity fibers was made, and the results are outlined below. The control was spun using a combing roll having a small positive tooth angle of about 15°, and the other sample was spun using a combing roll having a negative angle of about −5°. The samples were spun in the manner discussed with respect to the method as described above.

TABLE 1

DIRECT QUALITY COMPARISON

| | CONTROL (Positive Angle) | Negative Angle |
|---|---|---|
| Count | 4.48 Ne | 4.47 Ne |
| Size Variation | 1.4% | 1.0% |
| Uster Evenness | 11.8% | 10.7% |
| IPI Thin (50%) | 0 | 0 |
| Thick (50%) | 18 | 10 |
| Nep (200%) | 5 | 2 |
| Single End Break | 7.2 lbs. | 7.76 lbs. |
| Break Variation | 5.3% | 4.1% |

TABLE 1-continued

DIRECT QUALITY COMPARISON

| | CONTROL (Positive Angle) | Negative Angle |
|---|---|---|
| Elongation | 18.4% | 18.3% |

TABLE 2

PRODUCTION COMPARISON

| | Control (Positive Angle) | Negative Angle |
|---|---|---|
| Count | 4.5/1 | 4.5/1 |
| Delivery Speed | 130–148 ypm | 175 ypm |
| End Breakage | Due to high breakage, no conclusive data Estimated - 500 to 800 breaks/mrh | 75 to 150 breaks/mrh |
| Machine Efficiency | <80% | 92 to 96% |

As the results listed in the tables indicate, the yarn produced by the method of the instant invention produced superior yarns at increased rates of production. More specifically, the yarn produced according to the instant invention had superior evenness and higher strength, as evidenced by the comparison of Single End Break. In addition, the superior yarn was achieved at a higher delivery speed with fewer ends down, and a resulting much greater machine efficiency.

In the drawings and the specification, there has been set forth preferred embodiments of the invention and, although specific terms are employed, the terms are used in a generic and descriptive sense only and not for the purpose of limitation, the scope of the invention being set forth in the following claims.

That which is claimed is:

1. A method of open end spinning straight yarns from fine denier fibers of high single fiber tenacity comprising the steps of:

providing substantially all polyester sliver made from fibers about 1.3 denier or less in size and having a tenacity of at least about 5 grams per denier, combing said sliver with a combing roll having negative teeth to individualize the fibers;

feeding said individualized fibers to a rotor of an open end spinning machine to twist said fibers into a substantially straight spun yarn, and recovering the spun yarn.

2. The method according to claim 1, wherein the combing roll has teeth which have a negative tooth angle of about less than 0° to about −10°.

3. The method according to claim 2, wherein the combing roll has teeth which have a negative tooth angle of about less than 0° to about −5°.

4. The method according to claim 1, wherein the recovered yarns are about 12 Ne in size or larger.

5. The method according to claim 4, wherein the high tenacity polyester yarns are about 4.5 Ne in size or larger.

6. The method according to claim 1, wherein said recovering step comprises withdrawing the spun yarn through a smooth-naveled separator to impart tension to the spun yarn.

7. The method according to claim 6, wherein the navel comprises a chrome surface.

8. The method according to claim 1, wherein said method includes applying a vacuum at a pressure of about 85 to about 90 millibars to the rotor.

9. The method according to claim 8, wherein the step of combing comprises rotating the combing roll at 7600 rpm.

10. The method according to claim 1, wherein the yarns produced are straight yarns.

11. Polyester yarns produced according to the method of claim 1.

12. Polyester yarns according to claim 11, wherein the yarns are about 12 Ne or larger in size.

13. A method of open end spinning straight coarse count yarns from fine denier high tenacity fibers comprising the steps of:

providing substantially all-polyester sliver consisting essentially of about 1.3 denier per filament or less polyester fibers having a single fiber tenacity of at least about 5 grams per denier, combing the sliver with a combing roll having teeth with a negative tooth angle of about less than 0° to about −10°, passing combed fibers from the sliver to a rotor of an open end spinning machine, and twisting the combed fibers in the rotor of the open end spinning machine into a high tenacity polyester yarn.

14. The method according to claim 13, further comprising the step of rotating the combing roll at a speed of about 7600 rpm.

15. The method according to claim 13, further comprising the step of rotating the rotor at a speed of about 58,000 to about 90,000 rpm.

16. The method according to claim 13, wherein said method includes providing a vacuum to the rotor to transport the fibers from the combing roll to the rotor, and operating the vacuum at a pressure of about 85 to about 90 millibars.

17. The method according to claim 16, further comprising the step of rotating the combing roll at a speed of about 7600.

18. The method according to claim 13, wherein the yarns produced are about 12 Ne or coarser.

19. The method according to claim 13, wherein the tooth angle is about less than 0° to about −5°.

20. A method of open end spinning polyester yarns comprising the steps of:

providing substantially 100% polyester sliver formed from fibres about 1.3 denier or less in size and having a tenacity of about 5 grams per denier or greater and a staple length of about 1 and ¼ to about 2 inches, feeding said sliver to an open end spinning machine, combing fibers from the sliver by acting on the sliver with a rotating combing roll having a plurality of spaced apart negative teeth thereon, said roll rotating at about 7600 rpm, then transporting the fibers to a rotating rotor by way of vacuum, with said rotor rotating at about 58,000 to about 90,000 rpm to cause the fibers to collect in a groove located therein, and withdrawing the thus-collected fibers through a smooth-naveled separator in the form of a twisted yarn.

21. The method according to claim 20, wherein the twisted yarn is about 12 Ne or coarser in size.

22. The method according to claim 20, wherein said vacuum has a pressure of about 85–90 millibars.

* * * * *